US007588387B1

(12) United States Patent
Christensen et al.

(10) Patent No.: US 7,588,387 B1
(45) Date of Patent: Sep. 15, 2009

(54) BARRIERS WITH INTERLOCKING SIDES

(75) Inventors: Marc E. Christensen, Salt Lake City, UT (US); Greg H. Brown, Cleveland, OH (US); David E. Cowan, Cleveland, OH (US); Bryan D. Grabowski, Cleveland, OH (US); Charles M. Mettler, Cleveland, OH (US); Bruce E. Owens, Cleveland, OH (US); Patricia Russell, Salt Lake City, UT (US)

(73) Assignee: Off the Wall Products, LLC, Salt Lake City, UT (US)

( * ) Notice: Subject to any disclaimer, the term of this patent is extended or adjusted under 35 U.S.C. 154(b) by 704 days.

(21) Appl. No.: 11/360,820

(22) Filed: Feb. 23, 2006

Related U.S. Application Data

(60) Provisional application No. 60/666,866, filed on Mar. 31, 2005.

(51) Int. Cl.
*E01F 13/12* (2006.01)

(52) U.S. Cl. ..... 404/6; 404/9; 256/13.1

(58) Field of Classification Search ..... 404/6, 404/9; 256/13.1
See application file for complete search history.

(56) References Cited

U.S. PATENT DOCUMENTS

| | | | | | |
|---|---|---|---|---|---|
| 2,279,942 | A | * | 4/1942 | Hausherr | 256/13.1 |
| 3,326,099 | A | * | 6/1967 | Cova et al. | 404/7 |
| 3,980,279 | A | * | 9/1976 | Bofinger | 256/13.1 |
| 4,474,503 | A | * | 10/1984 | Booth et al. | 404/6 |
| 4,681,302 | A | * | 7/1987 | Thompson | 256/13.1 |
| 4,773,629 | A | | 9/1988 | Yodock | |
| 4,869,617 | A | | 9/1989 | Chiodo | |
| 5,011,325 | A | | 4/1991 | Antonioli | |
| 5,104,254 | A | * | 4/1992 | Durand | 404/6 |
| 5,123,773 | A | | 6/1992 | Yodock | |
| 5,137,391 | A | * | 8/1992 | Ballesteros | 404/6 |
| 5,452,963 | A | | 9/1995 | Christensen | |
| 5,498,101 | A | | 3/1996 | Braverman | |
| 5,531,540 | A | | 7/1996 | Wasserstrom et al. | |
| 5,604,413 | A | | 2/1997 | Brown | |
| 5,611,641 | A | | 3/1997 | Christensen | |
| 5,639,179 | A | | 6/1997 | Jensen | |
| 5,685,665 | A | * | 11/1997 | Lembo | 404/6 |

(Continued)

FOREIGN PATENT DOCUMENTS

| | | |
|---|---|---|
| AU | B-50241/93 | 11/1995 |

(Continued)

OTHER PUBLICATIONS

Dexterity Design, MB-2 Modifications for Light Receiver, 2 pages, Dec. 2001.

*Primary Examiner*—Raymond W Addie
(74) *Attorney, Agent, or Firm*—Workman Nydegger

(57) ABSTRACT

A barrier includes a housing having a front wall and an opposing back wall each extending between opposing sidewalls. The housing also includes a floor and an interior surface bounding a chamber, the chamber communicating externally through an inlet opening. A first inset projects into the chamber from the front wall so as to form a recessed blind pocket on the front wall. A second inset projects into the chamber from the back wall so as to form a recessed blind pocket on the back wall. The first inset and the second inset are connected together within the chamber so that the chamber encircles the connection.

12 Claims, 11 Drawing Sheets

U.S. PATENT DOCUMENTS

| | | | | | |
|---|---|---|---|---|---|
| D400,264 | S | | 10/1998 | Striefel et al. | |
| 5,836,714 | A | | 11/1998 | Christensen | |
| 5,882,140 | A | | 3/1999 | Yodock, Jr. et al. | |
| 5,988,934 | A | | 11/1999 | Wasserstrom | |
| 5,993,103 | A | * | 11/1999 | Christensen | 404/6 |
| 6,059,491 | A | * | 5/2000 | Striefel et al. | 405/111 |
| 6,085,458 | A | * | 7/2000 | Gau | 47/33 |
| 6,086,285 | A | | 7/2000 | Christensen | |
| 6,164,865 | A | * | 12/2000 | McCallum | 404/6 |
| D462,126 | S | | 8/2002 | Englund | |
| 6,474,904 | B1 | * | 11/2002 | Duckett et al. | 404/6 |
| 6,666,616 | B2 | | 12/2003 | Yodock, III et al. | |
| 6,672,799 | B2 | | 1/2004 | Earl | |
| 6,837,647 | B2 | * | 1/2005 | Tagg | 404/6 |
| 6,843,614 | B2 | | 1/2005 | Yodock, Jr. et al. | |
| 7,303,353 | B2 | * | 12/2007 | Carey | 404/6 |
| D569,992 | S | * | 5/2008 | Christensen et al. | D25/38 |

FOREIGN PATENT DOCUMENTS

| | | | | |
|---|---|---|---|---|
| EP | 0 407 277 | A2 | | 1/1991 |
| EP | 0 442 249 | A1 | | 8/1991 |
| EP | 0 550 362 | A1 | | 7/1993 |
| GB | 2 219 332 | A | | 12/1989 |
| GB | 2 237 832 | A | | 5/1991 |
| WO | WO2004/009909 | A1 | * | 1/2004 |

* cited by examiner

BARRIERS WITH INTERLOCKING SIDES

CROSS-REFERENCE TO RELATED APPLICATIONS

This application claims benefit to U.S. Provisional Patent Application Ser. No. 60/666,866, filed on Mar. 31, 2005, which for purposes of disclosure is incorporated herein by specific reference.

BACKGROUND OF THE INVENTION

1. The Field of the Invention

The present invention relates to barriers, and more particularly, portable, reusable, control barrier systems for use in controlling pedestrian traffic, automobile traffic, and the like.

2. The Relevant Technology

Control barriers are used in a variety of situations. For example, control barriers can be selectively positioned at special events or construction sites to help direct pedestrian and automobile traffic in a desired direction. Alternatively, control barriers can be put up to help limit access to select areas. In yet other embodiments, control barriers can be put up to define an entertainment stage or the boundaries of a playing field. For example, control barriers can be used to define the boundaries of a soccer field or an ice skating rink.

Conventional control barriers have long comprised individual sawhorse type barriers or collapsible V-shape barricades. Such barriers, however, have limited use since they are generally lightweight and are thus easily tipped over or moved. This can be a problem when large crowds are encountered or when the barriers are being used on a playing field where they might get bumped. Furthermore, such barriers are typically not connected and often have spaces or gaps extending therethrough. As such, it is possible for individuals to either slip between or through the barriers.

Other barriers comprise various gates or walls which are constructed. Such barriers, however, require extensive time to assemble and disassemble. In yet other alternative embodiments, concrete barriers have been used. Although concrete barriers are not easily tipped over, such barriers are extremely heavy. As such, they are difficult to move and place in desired locations. Often, special equipment such as fork lifts or cranes are required. Furthermore, concrete barriers can be both difficult and expensive to move over large distances and require a large area to store. Concrete barriers can also be dangerous in that they are rigid and non-forgiving when impacted by a person.

In one attempt to overcome some of the above problems, plastic barriers have been made. The plastic barriers are hollow and can be filled with water for stabilizing. Although an improvement, existing plastic barriers also have several limitations. For example, plastic barriers are typically large and bulky. As a result, they are not easily stacked and require large areas to store and transport.

Furthermore, many plastic barriers are designed to be free standing where the barriers cannot be connected together. Such non-connected barriers are less effective against restraining the impact of a large force, such as the impact of a car. Other plastic barrier systems require separate connectors or rods to connect the barriers together. The required use of separate connectors or rods can make assembly difficult and time consuming. Furthermore, additional expense is incurred in the manufacture, transportation and storage of the separate connects.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
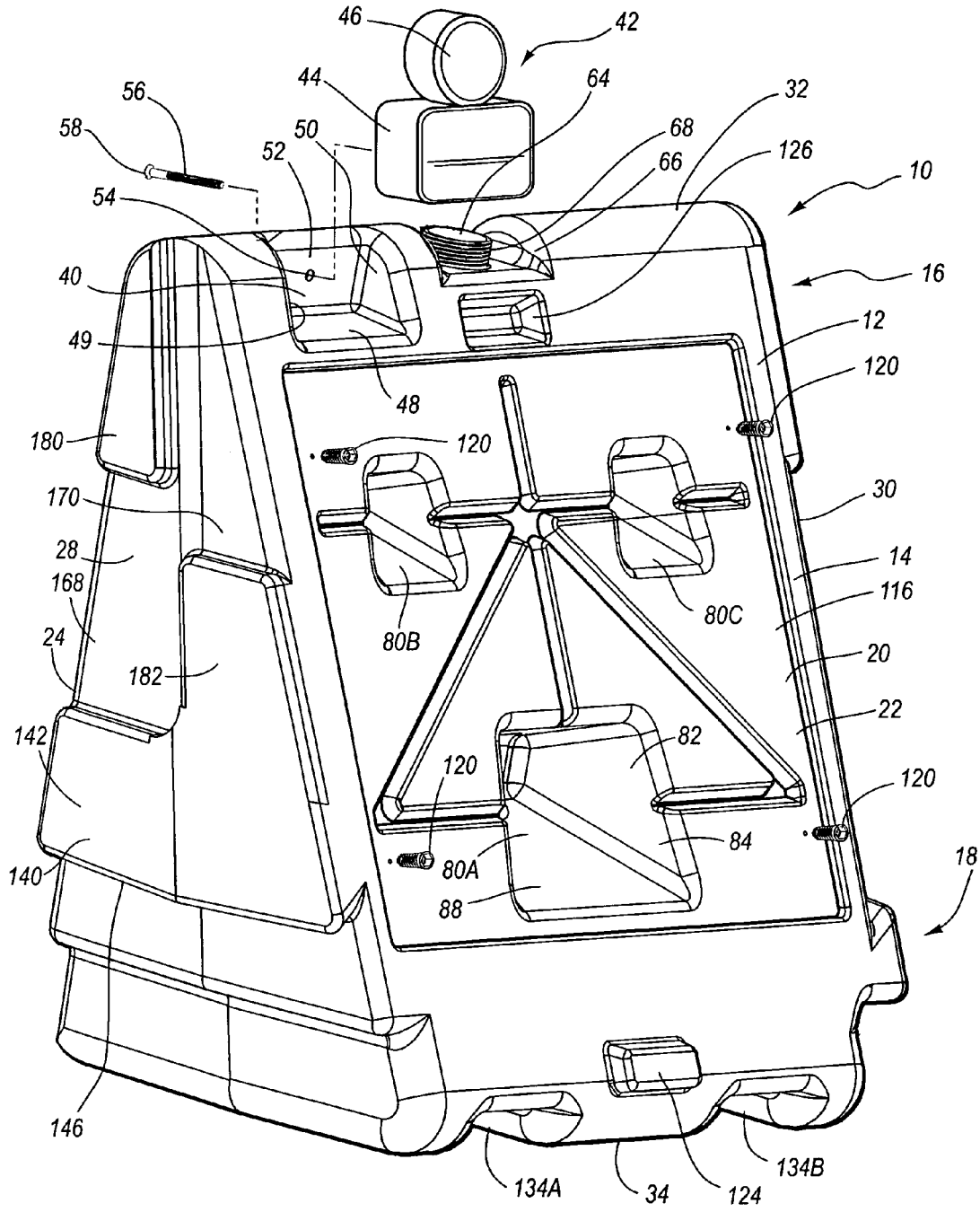
FIG. 1 is a front perspective view of one embodiment of a barrier of the present invention.
Figure 2:
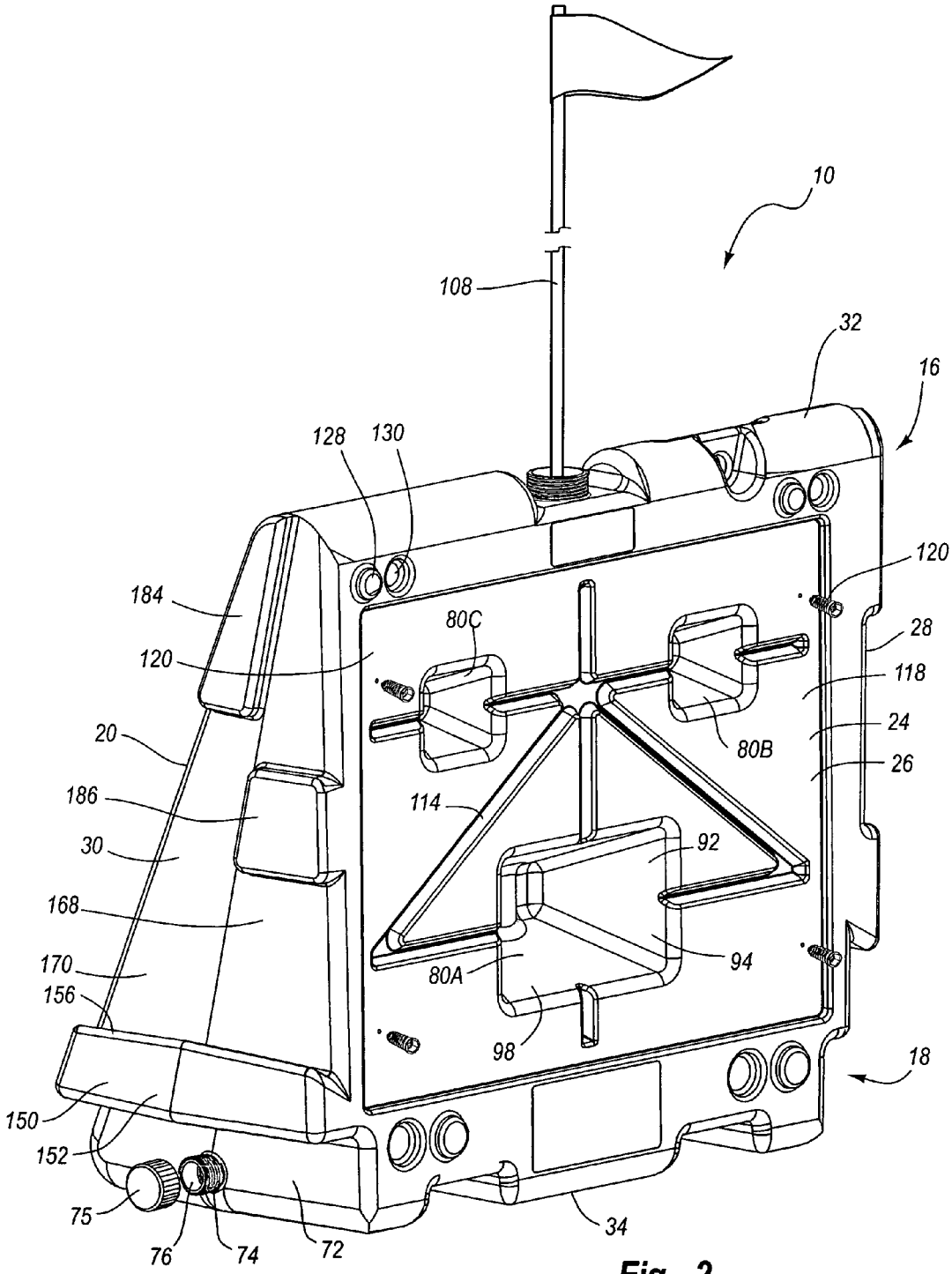
FIG. 2 is a back perspective view of the barrier shown in FIG. 1.

Depicted in FIGS. 1 and 2 is one embodiment of an inventive barrier 10 incorporating features of the present invention. Barrier 10 comprises a housing 12 having an exterior surface 14. Housing 12 generally has an upper end 16 and an opposing lower end 18. Housing 12 structurally includes a front wall 20 having a front face 22 and an opposing back wall 24 having a back face 26. Front wall 20 and back wall 24 each extend between a first sidewall 28 and an opposing second sidewall 30. Front wall 20 and back wall 24 also extend between a top end 32 located at upper end 16 and a floor 34 located at lower end 18. Each of sidewalls 28 and 30 likewise extend between top end 32 and floor 34.

Figure 3:
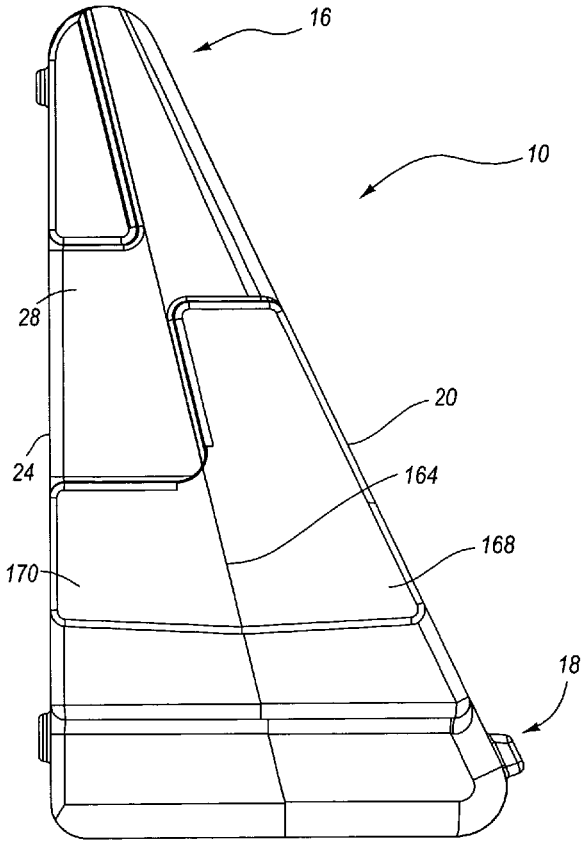
FIG. 3 is an elevated left side view of the barrier shown in FIG. 1.
Figure 4:
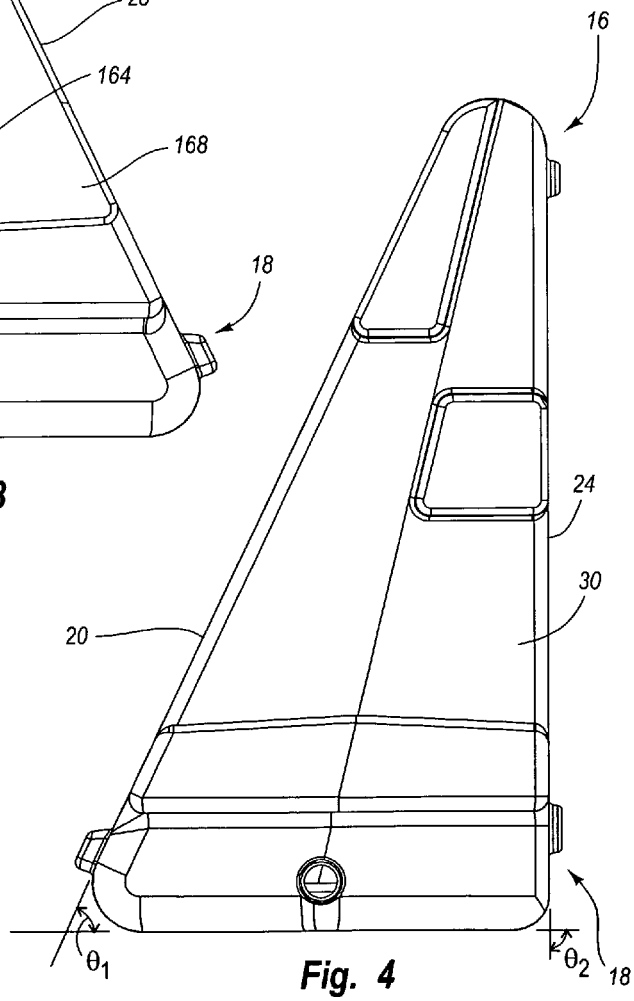
FIG. 4 is an elevated right side view of the barrier shown in FIG. 1.

Front wall 20 and back wall 24 are depicted as being substantially rectangular. In alternative embodiments front wall 20 and back wall 24 can have alternative geometrical shapes such as square, other polygonal configurations, or can be curved such as to form a corner. As depicted in FIGS. 3 and 4, sidewalls 28 and 30 are substantially triangular being wider at lower end 18. More specifically, sidewalls 28 and 30 each substantially form a right triangle with back wall 24 being substantially vertically oriented and front wall 20 being sloped relative to back wall 24. As used in the specification and appended claims, all relative orientations with regard to barrier 10, such as up, down, vertical, horizontal, and the like are made with respect to floor 34 being disposed in a flat horizontal plane as depicted in FIGS. 3 and 4. In the embodiment depicted, front wall 20 intersects with floor 34 at an inside angle $\theta_0$ in a range between about 60° to about 80° with about 70° to about 80° being more preferred and about 75° being most preferred. Other angles can also be used. Back wall 24 intersects with floor 34 at an angle $\theta_2$ of about 90°. In alternative embodiments, sidewalls 28 and 30 can have a trapezoidal or other geometric configurations. As such, angle $\theta_2$ can also be in a range between about 60° to about 90°. Thus, in other embodiments front wall 20 and back wall 24 can be disposed in parallel planes, can each slope in intersecting planes, or one wall can be vertical while the other wall slopes relative thereto.

Returning to FIG. 1, in some embodiments a recess 40 is formed at upper end 16 of housing 12. Recess 40 is formed on top end 32 and front wall 20 and is sized to accommodate a standard barrier light 42. Barrier light 42 comprises a housing 44 in which a battery is disposed and a lens 46 in which a light filament is disposed. Barrier light 42 can have a variety of other configurations. Recess 40 is bounded by a floor 48, opposing sidewalls 49 and 50, and a partition wall 52. Partition wall 52 is formed between recess 48 and back face 26 of back wall 24. In one embodiment, recess 40 has a width extending between sidewalls 49 and 50 that is typically in a range between about 10 cm to about 30 cm, a height extending between floor 48 and the top surface of top end 32 in a range between about 10 cm to about 30 cm, and a depth between about 10 cm to about 30 cm. Other dimensions can also be used.

In the embodiment shown, recess 40 extends into front wall 20. In alternative embodiments, it is appreciated that recess 40 can be formed as a pocket that is recessed only into top end 32 but does not extend through front wall 20. Other configurations can also be used.

Barrier light 42 can be secured within recess 40 using any conventional methods such as screws, bolts, clips, Velcro or other known fastening methods. In the embodiment depicted, a hole 54 extends through partition wall 54. A bolt 56 having an enlarged head 58 and an opposing threaded end can be selectively passed through hole 54 so as to engage housing 44, thereby securing barrier light 42 with recess 40. Bolt 56 can also be replaced with other fasteners such as screws, pins, expansion bolts, and the like. This assembly provides protection for barrier light 42 which is partially sheltered within recess 40 while providing secure engagement with barrier 10.

Figure 5:
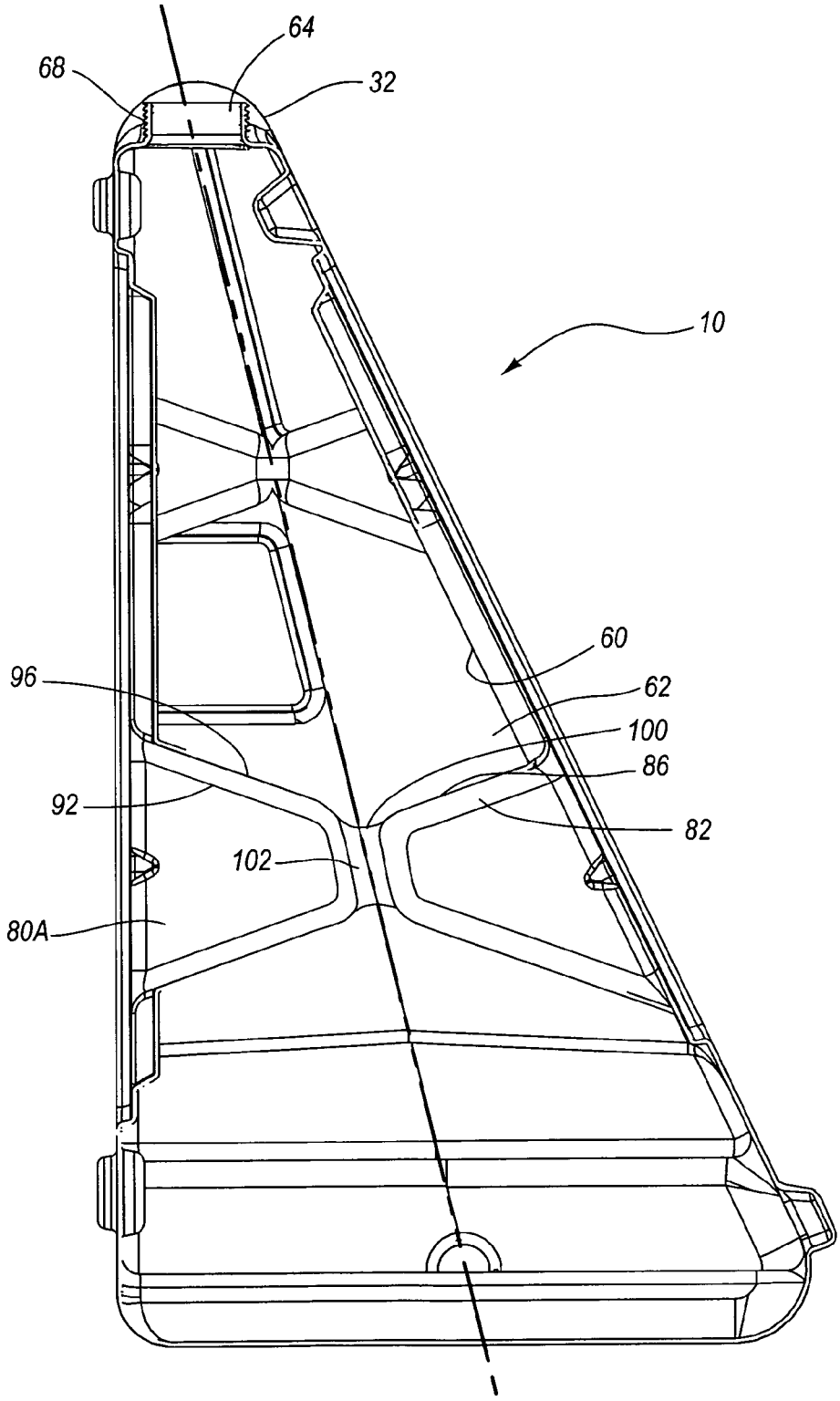
FIG. 5 is a cross-sectional side view of the barrier shown in FIG. 1.

As depicted in FIG. 5, barrier 10 also has an interior surface 60 that bounds an internal chamber 62. Internal chamber 62 is configured to receive a ballast. As used in the specification and appended claims, the term "ballast" is broadly intended to include any materials which can be poured into internal chamber 62. By way of example and not by limitation, the ballast can include water, salt water, non-freezing fluids, sand, rock, cement, concrete, and the like.

Figure 12:
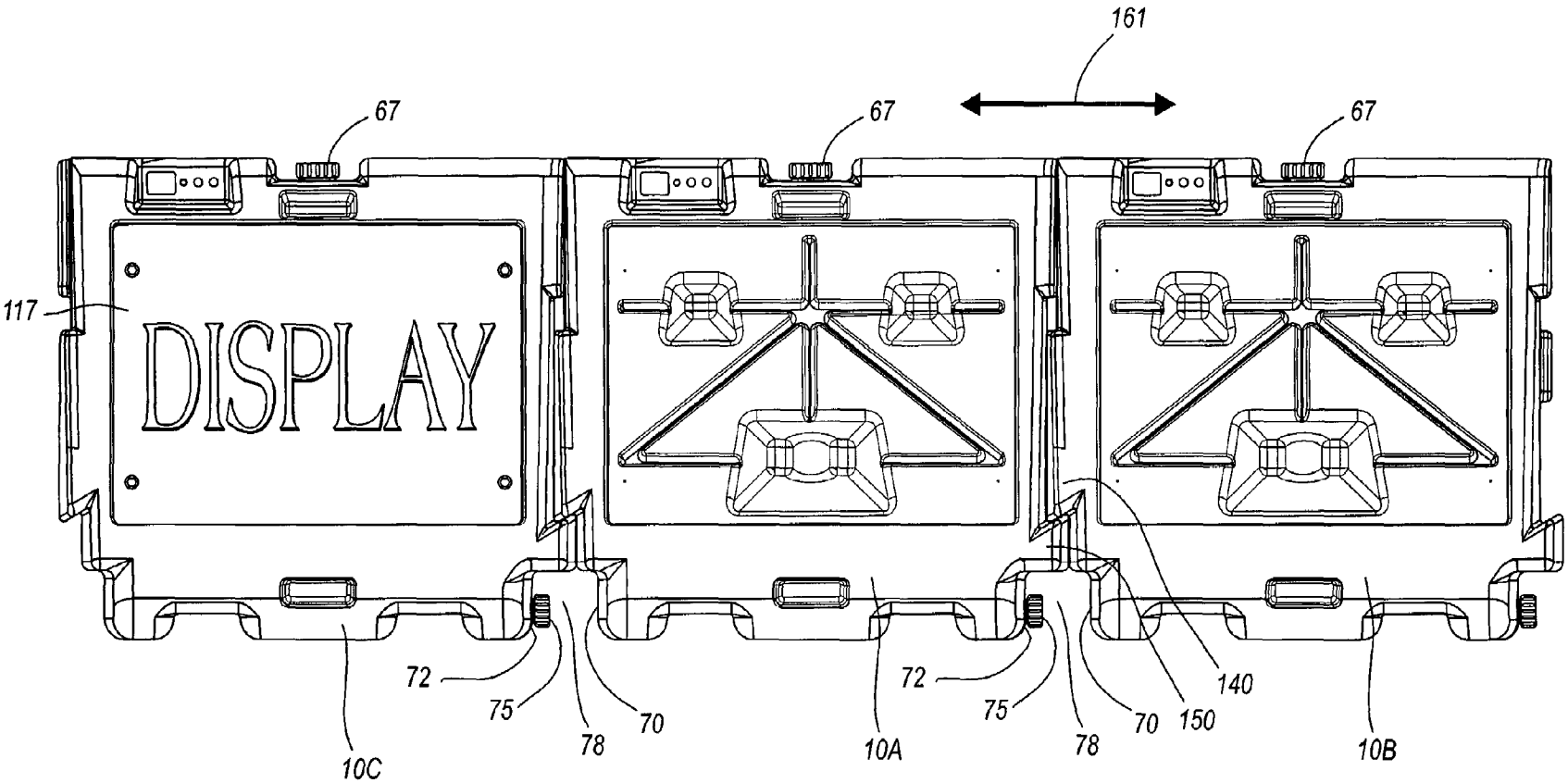
FIG. 12 is a front view of a plurality of barriers connected together.

In one embodiment of the present invention, means are provided for filling internal chamber 62 with ballast. By way of example and not by limitation, internal chamber 62 communicates externally through an opening 64 located on top end 32. Specifically, as depicted in FIG. 1, a notch 66 is formed on top end 32. A threaded, tubular stem 68 projects from housing 12 within notch 66 and bounds opening 64. Opening 64 can be selectively closed or sealed by a cap 67 (FIG. 12). Notch 66 provides a partially protected spaced for stem 68 and related cap 67. In alternative embodiments, opening 64 can be positioned at other locations on barrier 10 and can be formed without notch 66 and/or stem 68. For example, opening 64 can be formed directly on housing 12 and a plug can be used to stop opening 64.

Figure 7:
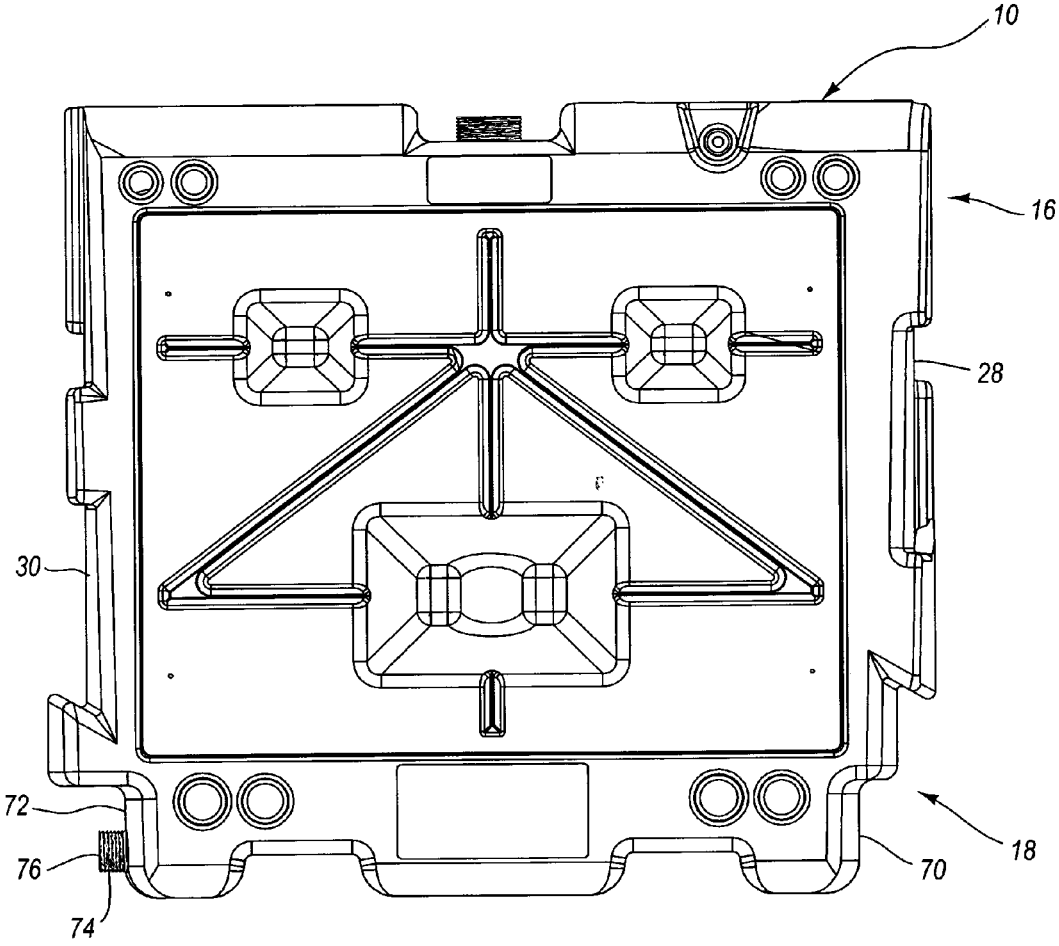
FIG. 7 is an elevated back view of the barrier shown in FIG. 1.

Means are also provided for selectively draining ballast from barrier 10. By way of example and not by limitation, as depicted in FIG. 7, each of sidewalls 28 and 30 has a base portion 70 and 72 located at lower end 18 which have been inset toward each other. Centrally projecting from base portion 72 is a threaded, tubular stem 74 that bounds a drain hole 76. A cap 75 (FIG. 12) can be screwed into or otherwise attached to stem 74 so as to sealing drain hole 76 closed. In alternative embodiments, drain hole 76 can also be positioned at other locations on barrier 10. Likewise, as with opening 64, drain hole 76 can be formed without stem 74. Here it is noted that by insetting base portions 70 and 72, a channel 78 is formed between base portions 70 and 72 of adjacently coupled barriers as depicted in FIG. 12. Channel 78 provides a partially protected space for stem 74 and related cap 75.

Although not required, in the depicted embodiment of the present invention, barrier 10 comprises a plurality of kiss-offs 80A, 80B and 80C which extend between front wall 20 and back wall 24. Depicted in FIG. 1, kiss-off 80A comprises a front inset 82 that projects from front wall 20 into chamber 62 toward back wall 24. Front inset 82 has an outside face 84 and an inside face 86 (FIG. 5). Outside face 84 bounds a recessed, blind pocket 88 on front wall 20 while inside face 86 communicates with chamber 62. Depicted in FIG. 2, kiss-off 80A also comprises a back inset 92 that projects from back wall 24 into chamber 62 toward front wall 20. Back inset 92 has an outside face 94 and an inside face 96 (FIG. 5). Outside face 94 bounds a recessed blind pocket 98 on back wall 24 while inside face 96 communicates with chamber 62. Turning to FIG. 5, within chamber 62, a portion of front inset 82 and a portion of back inset 92 are connected together, such as by being integrally molded together, at a joint 100. Joint 100 is encircled by chamber 62. Because insets 82 and 92 are connected together, insets 82 and 92 increase the structural stability of barrier 10 and also reinforce front wall 20 and back wall 22 so as to prevent or limit unwanted bowing or deformation of walls 20 and 22 as chamber 62 is filled with ballets.

Figure 8:
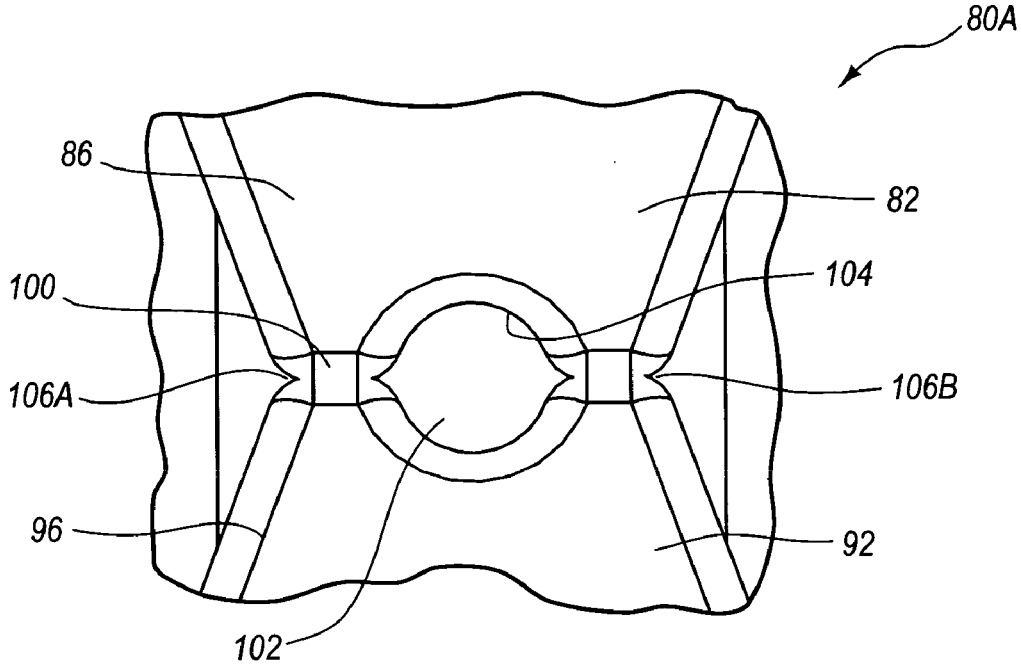
FIG. 8 is a top plan view of a kiss-off of the barrier shown in FIG. 1.

In one embodiment, a vertically oriented channel 102 is formed between front inset 82 and back inset 92 so as to pass through kiss-off 80A. As shown in FIG. 8, channel 102 is bounded by an interior surface 104 that completely encircles channel 102. In this embodiment, joint 100 can be comprised of two portions 106A and 106B on opposing sides of channel 102. Depicted in FIG. 5, channel 102 is aligned with opening 64 so that an elongated member, such as pole 108 in FIG. 2, can be passed down through opening 64 and channel 102. Kiss-off 80A bounding channel 102 laterally supports the elongated member so as to prevent unwanted movement of the elongated member. It is appreciated that the elongated member can comprises a pole, post, flag, or some other support structure on which displays of other structural members can be connected.

Figure 9:
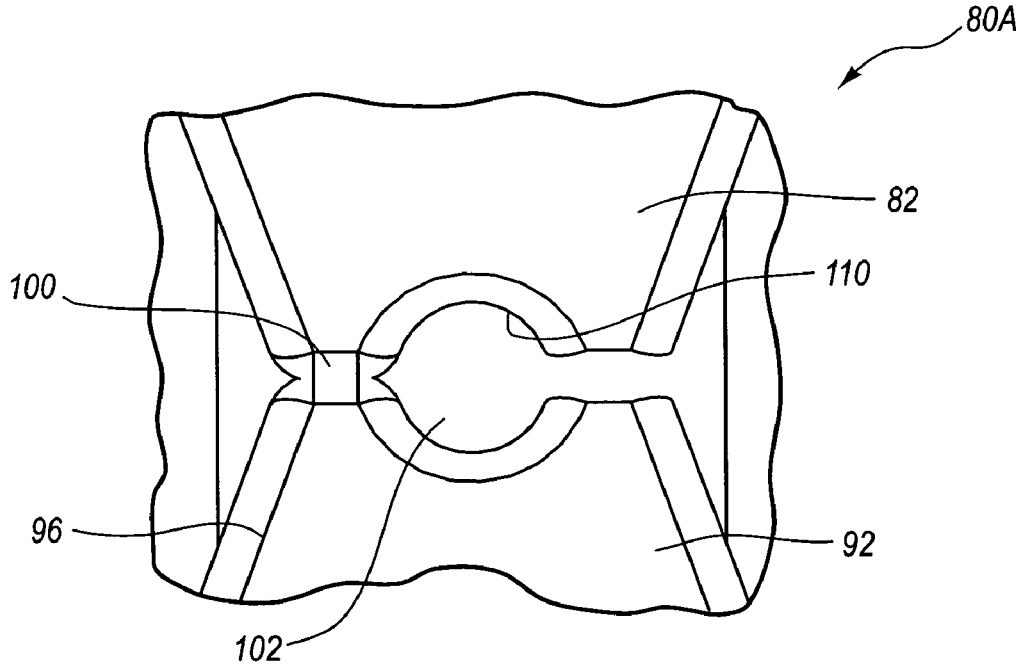
FIG. 9 is a top plan view of an alternative embodiment of the kiss-off shown in FIG. 8.

It is appreciated that kiss-off 80A can be formed in a variety of other configurations. For example, kiss-off 80A can be formed so that channel 102 only partially passes through kiss-off 80A, thereby forming a blind pocket. In yet other embodiments as depicted in FIG. 9, kiss-off 80A can be formed with a sidewall 110 that only partially encircles channel 102. For example, sidewall 110 can encircle at least 70%, 80%, or 90% of the radial circumference of channel 102. In this embodiment, joint 100 is only formed on one side of channel 102. In still other embodiments, channel 102 can be formed between front inset 82 and back inset 92 when insets 82 and 92 are spaced apart so that they do not connect together. Likewise, channel 102 can be eliminated. For example, kiss-offs 80B and 80C have substantially the same configuration as kiss-off 80A and as such, like elements can be identified by like reference characters. However, kiss-offs 80B and 80C are formed without channel 102.

It is also appreciated that one of front inset 82 and back inset 92 can be eliminated. For example, front inset 82 can extend across chamber 62 and connect directly to back wall 24 or back inset 92 can extend across chamber 62 and connect directly to front wall 20. Each inset 82 and 92 is shown having a substantially square or rectangular transverse cross section. In alternative embodiments, it is appreciated that insets 82 and 92 can have a circular, irregular, or other polygonal transverse cross section. In addition, although barrier 10 is shown having three kiss-offs 80A, 80B, and 80C, in alternative embodiments, barrier 10 can be formed with one, two, or four or more kiss-offs having the same or different size and/or shape.

One of the benefits of using the kiss-offs is that they increase the rigidity or stability of barrier 10, i.e., they help prevent unwanted or excessive deformation of the walls, when barrier 10 is filled with a ballast. In turn, by increasing the stability of barrier 10, the wall thickness for barrier 10 can be reduced. The reduction in wall thickness decreases material cost and makes barrier 10 lighter so that it is easier to move and transport. In one embodiment, using kiss-offs, as compared to not using kiss-offs, can enable the wall thickness to be reduced by about 25% to about 50%, at least in some areas, without loss of stability.

Depicted in FIGS. 1 and 2, to further reinforce the structural stability of front wall 20 and back wall 24 so as to prevent or minimize bowing, channels 114 can be formed on front wall 20 and back wall 24. Channels 114 can be formed in any desired orientation and pattern. In alternative embodiments, channel 114*s* can be replaced with outwardly projecting ribs or other integrally formed structures that facilitate reinforcing.

In one embodiment it is desirable to minimizing bowing or deformation of front wall 20 and back wall 24 so that displays or other structures can be mounted on front wall 20 and back wall 24. For example, front face 22 of front wall 20 comprises a recessed display portion 116 while back face 26 of back wall 24 comprises a recessed display portion 118. Display portions 116 and 118 are configured to receive a display 117 (FIG. 12) such as a sign or other form of flat panel. Mounted on each of display portions 116 and 118 are a plurality of spaced apart tubular inserts 120 that bound a threaded channel. Inserts 120 are typically comprised of metal and can be secured to housing 12 during the molding of housing 12 or can be mounted on housing 12 after molding. By attaching inserts 120 to housing 12, display 117 can be mounted on housing 12 by using screw, bolts or other fasteners that pass through display 117 and screw into inserts 120.

Figure 10:
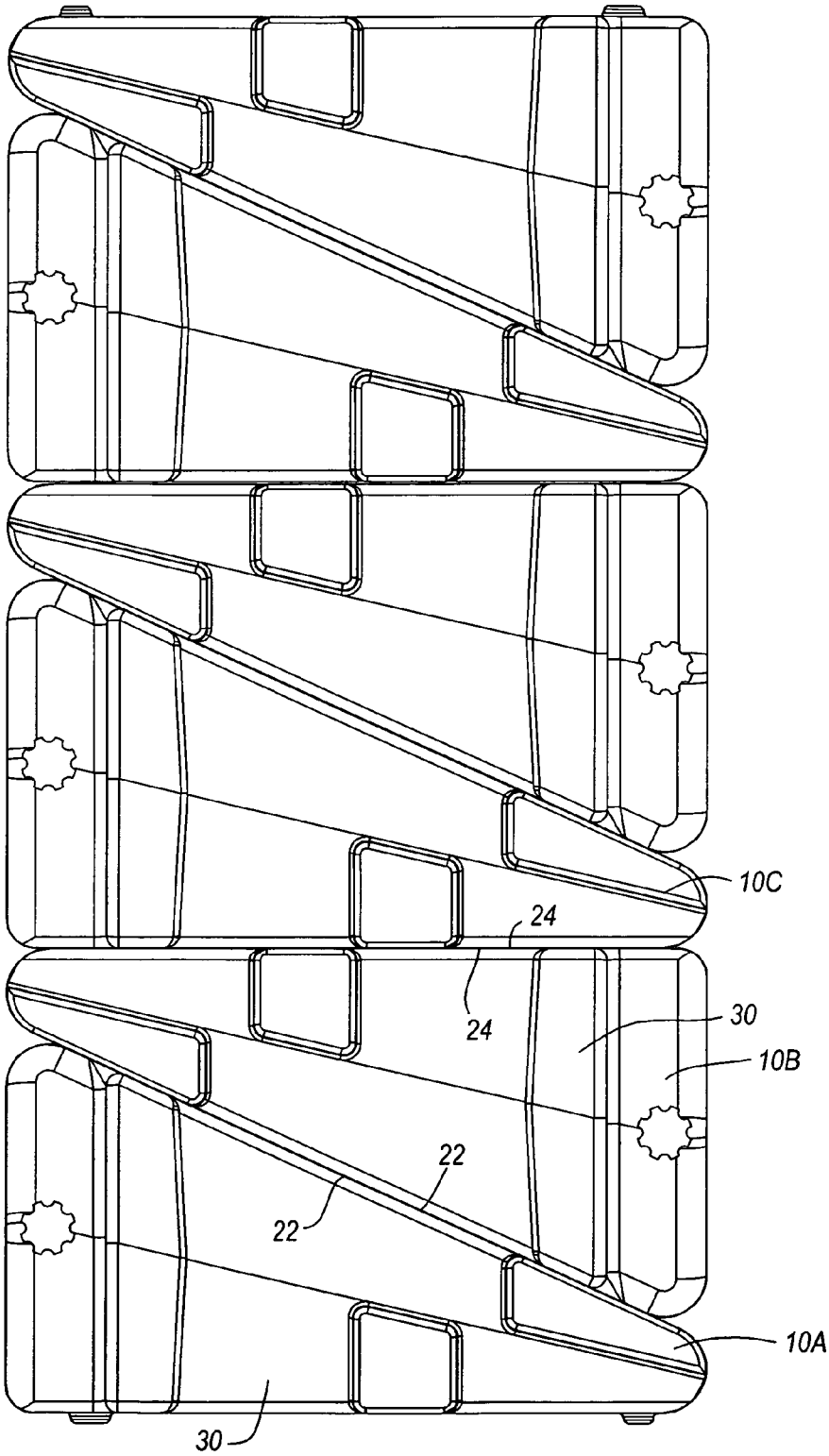
FIG. 10 is an elevated side view of a plurality of stacked barriers.

The present invention also includes means for mating a pair of barriers together for transport and/or storage. As depicted in FIGS. 1 and 2, by way of example and not by limitation, a tenon 124 projects from front wall 22 at lower end 18 while a complementary mortise 126 is recessed on front wall 22 at upper end 16. As depicted in FIG. 10, by inverting a second barrier 10B and mating front walls 22 thereof together, tenon 124 of each barrier 10A and 10B is received within the corresponding mortise 126 of the other barrier. As such, barriers 10A and 10B are securely mated together. When sidewalls 28 and 30 form a right triangle, the resulting mated barriers 10A and 10B have a substantially cubed or parallelepiped configuration which can be easily stacked, loaded, moved, stored, and/or transported. In alternative embodiments, tenon 124 and mortise 126 can be a variety of alternative configurations and need only be constructed so that they mate together.

Depicted in FIG. 2, located at each corner of back wall 24 is a circular tenon 128 and an adjacent circular mortise 130. Again the tenons 128 and mortises 130 are configured and orientated so that by inverting a barrier 10C and mating back walls 24 thereof together (FIG. 10), tenons 128 of barriers 10B and 10C are received within corresponding mortises 130 of the opposing barrier. As a result the barriers can be repeatedly stacked in a secure interlocking arrangement.

Figure 11:
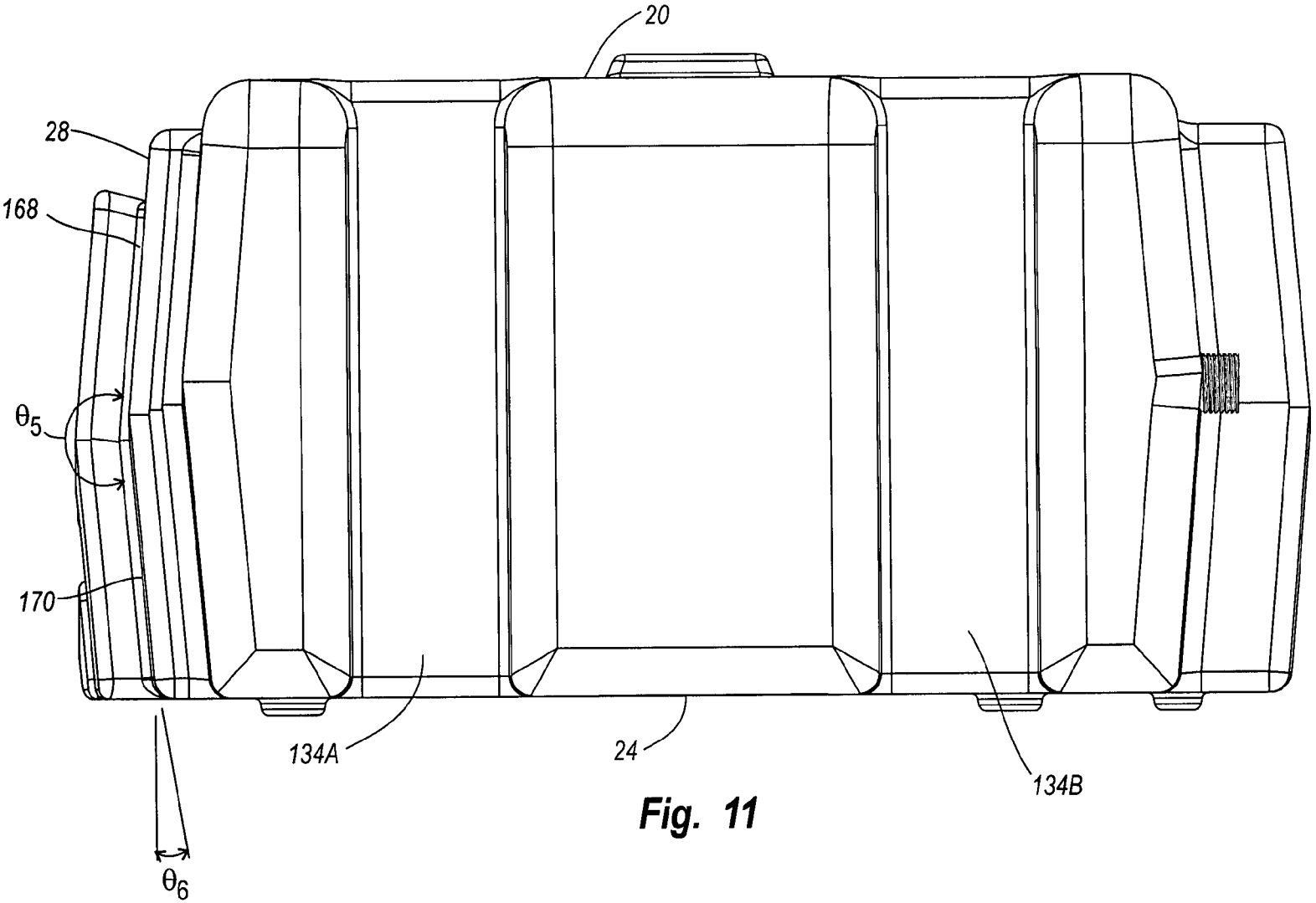
FIG. 11 is a bottom plan view of the barrier shown in FIG. 1.

Depicted in FIG. 11 is the exterior surface of floor 34 according to one embodiment. A pair of spaced apart fork lift channels 134A and 134B are recessed on floor 34 and extend from front wall 20 to back wall 24. Fork lift channels 134A and 134B are configured to receive the tines of a fork lift such that, if desired, barrier 10 can be moved by a fork lift even if filled with ballast. If desired, pads comprised or rubber, old car tires, or other material having a higher coefficient of friction than barrier 10, can be secured to floor 34 to increase the coefficient of friction of barrier 10.

Returning to FIG. 1, projecting from sidewall 28 is an engaging catch 140 having an end face 142 that transversely extends across sidewall 28 between front wall 20 and back wall 24. Depicted in FIG. 6, engaging catch 140 also includes an engaging face 144 that projects from sidewall 28 and interests with a lower end of end face 142 along an engaging lip 146. Both engaging face 144 and engaging lip 146 also transversely extend across sidewall 28 between front wall 20 and back wall 24. Engaging face 144 slopes downwardly and away from sidewall 28 so as to form an inside angle $\theta_3$ between engaging face 144 and sidewall 28 that is typically in a range between about 70° to about 20° with about 55° to about 35° being more common. Other angles can also be used. As a result of the orientation of engaging face 144, a substantially V-shaped slot 148 is formed between engaging face 144 and sidewall 28 that transversely extends across sidewall 28.

Figure 6:
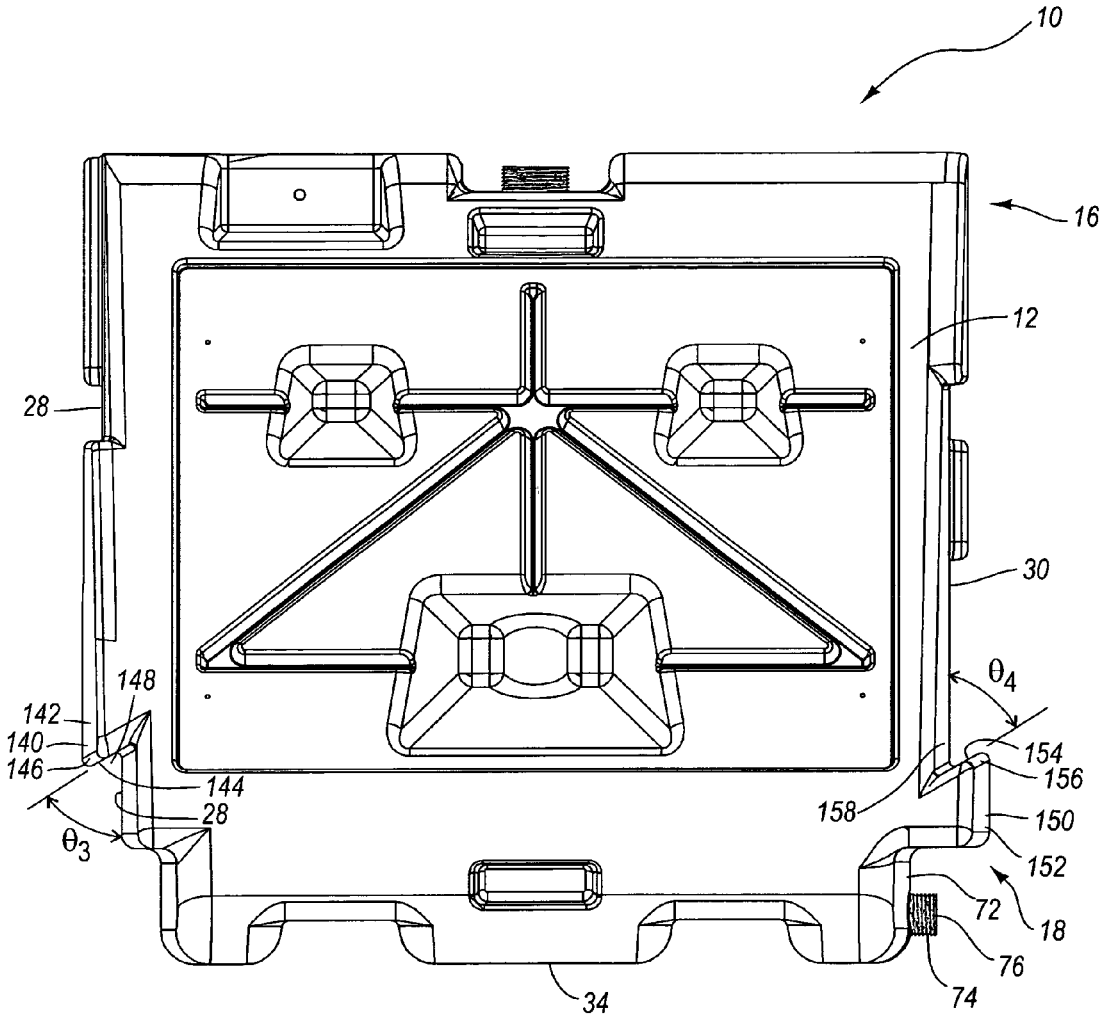
FIG. 6 is an elevated front view of the barrier shown in FIG. 1.

Turning to FIG. 2, projecting from sidewall 30 is a retention catch 150 having an end face 152 that transversely extends across sidewall 30 between front wall 20 and back wall 24. As depicted in FIG. 6, retention catch 150 also includes a retention face 154 that projects from sidewall 30 and interests with an upper end of end face 152 along a retention lip 156. Both retention face 154 and retention lip 156 transversely extend across sidewall 30 between front wall 20 and back wall 24. Retention face 154 slopes upwardly and away from sidewall 30 so as to form an inside angle $\theta_4$ between retention face 154 and sidewall 30 that is typically in a range between about 70° to about 20° with about 55° to about 35° being more common. In one embodiment, $\theta_4$ is substantially the same as $\theta_3$. Again, other angles can also be used. As a result of the orientation of retention face 154, a substantially V-shaped slot 158 is formed between retention face 154 and sidewall 30 that transversely extends across sidewall 30.

Engaging catch 140 and retention catch 150 are positioned on housing 12 such that adjacent barriers 10A and 10B can be interlocked to prevent unwanted lateral separation. Specifically, with reference to FIGS. 6 and 12, engaging lip 146 of barrier 10B can be received within retention slot 158 of barrier 10A while simultaneously retention lip 156 is received within engaging slot 148. Lateral separation of barriers 10A and 10B in the direction of arrows 161 is prevented as a result of engaging face 144 contacting retention face 154. It is appreciated that this connection between barriers 10A and 10B increases as one or both of barriers 10A and 10B are filled with a ballast. It is also noted that both engaging catch 140 and retention catch 150 are vertically spaced above floor 34 so as to provide room for drain hole 76 and related stem 74.

It is appreciated that engaging catch 140 and retention catch 150 can have a variety of different configurations. For example, end faces 142 and 152 are depicted as being disposed in a vertically oriented plane. In alternative embodiments, end faces 142 and 152 can sloped such as into or away from sidewalls 28 and 30. Furthermore, engaging catch 140 and retention catch 150 can be formed so as to only traverse a portion of sidewalls 28 and 30 as opposed to extending completely across sidewalls 28 and 30. In yet other embodiments, a plurality of spaced apart engaging catches 140 and retention catches 150 can be formed on sidewalls 28 and 30. The plurality of engaging catches 140 and retention catches 150 can be laterally and/or vertically spaced apart. In the depicted embodiments, lips 146, 156 and related slots 148, 158 are horizontally disposed. In alternative embodiments, they can also be sloped at complementary angles. Furthermore, slots 148 and 158 need not be V-shaped but can be U-shaped or have other configurations that enable interlocking between adjacent barriers.

In one embodiment, sidewalls 28 and 30 can be substantially planar and vertically oriented. In the depicted embodiment, however, each of sidewalls 28 and 30 has a shallow, substantially V-shaped transverse cross section when view in a plane parallel to floor 34. Specifically, as depicted in FIG. 3 sidewall 28 has a substantially linear ridge line 164 that centrally extends from lower end 18 of sidewall 28 to a central location of upper end 16 of sidewall 28. As a result, ridge line 164 substantially bisects sidewall 28 into a front portion 168 and a back portion 170. In one embodiment, ridge line 164 corresponds with a mold line for barrier 10. Front portion 168 slopes inward from ridge line 164 to front wall 20 while back portion 170 slopes inward from ridge line 164 to back wall 24. As a result, as depicted in FIG. 11, an outside angle θ5 is formed between front portion 168 and back portion 170 in a range between about 185° to about 240° with about 195° to about 225° being more common. Expressed in other terms, front portion 168 and back portion 170 slope at and angle $\theta_6$ relative to a vertical plane normal to back wall 24 in a range between about 5° to about 35° with about 10° to about 25° being more common. Other angles can also be used. Sidewall 30 has the same V-shaped transverse cross section as sidewall 28.

Figure 13:
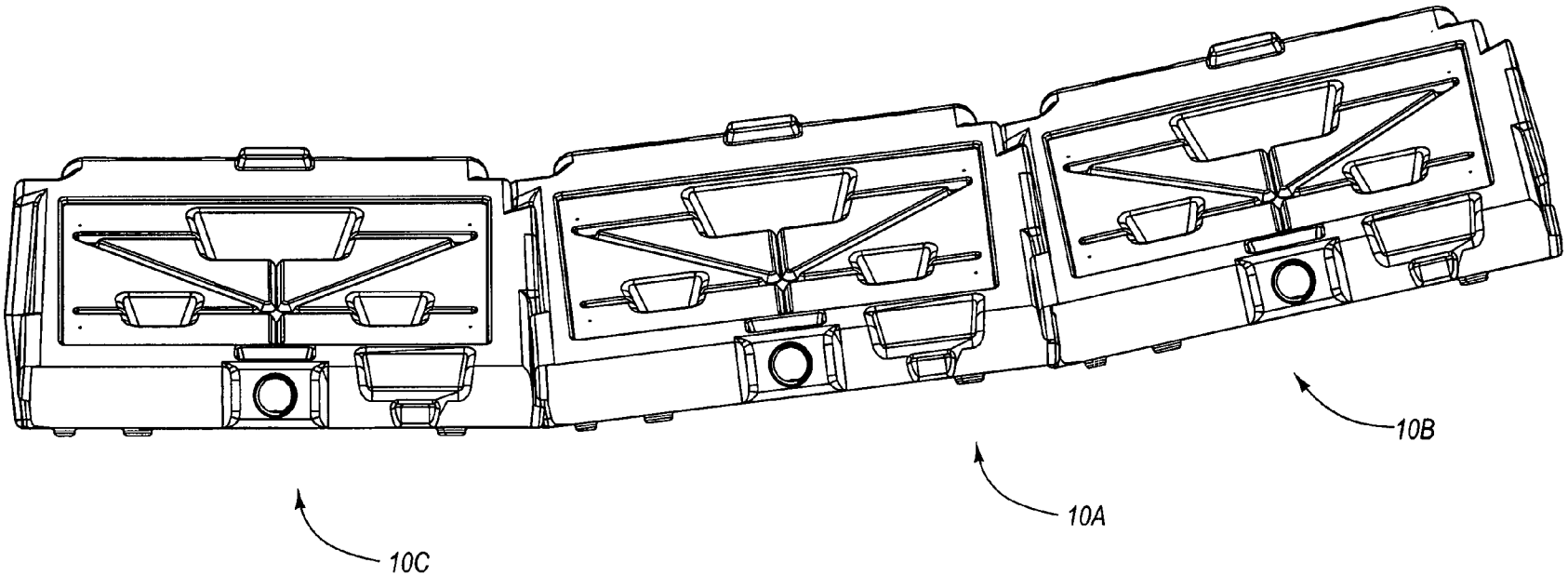
FIG. 13 is a top plan view of a plurality of barriers connected together.

Engaging catch 140 and retention catch 150 and their related components are also bisected by ridge line 164 and their bisected portions slope at substantially the same angles as front portion 168 and back portion 170 of sidewalls 28 and 30. As a result, each of engaging catch 140 and retention catch 150 also has a substantially V-shaped transverse cross section. When the engaging catch 140 and retention catch 150 of adjacent barriers are interlocked as discussed above, the opposing V-shaped configuration of each catch 140 and 150 forms a gap between engaging face 144 and retention face 154 at each opposing end of catches 140 and 150. This gap enables one of connected barrier 10A and 10B to be turned relative to the other as depicted in FIG. 13. As a result, a string of connected barrier 10 can be coupled together in a straight line or in a curved path. In part, the extent to which one barrier 10 can be turned relative to another barrier 10 depends on the angle of the V-shaped transverse cross section.

The present invention also provides means for minimizing transverse movement between connected barriers. By way of example and not by limitation, depicted in FIG. 1 is a first upper stop 180 projecting from back portion 168 of sidewall 28. A first lower stop 182 projects from front portion 170 of sidewall 28 at a location below first upper stop 180. In this embodiment, first upper stop 180 and first lower stop 182 are both vertically and laterally spaced apart. Turning to FIG. 2, a second upper stop 184 projects from front portion 170 of sidewall 30. A second lower stop 186 projects from back portion 168 of sidewall 30 at a location below second upper stop 184. In this embodiment, second upper stop 184 and second lower stop 186 are both vertically and laterally spaced apart.

Stops 180, 182, 184 and 186 are configured so that when adjacent barriers are coupled together, as depicted in FIG. 12, upper stops 180 and 184 are disposed horizontally adjacent to each other and lower stops 182 and 186 are disposed horizontally adjacent to each other. As a result, transverse contact between upper stops 180 and 184 and between lower stops 182 and 186 prevents unwanted transverse separation between barriers 10A and 10B. It is appreciated that stops 180, 182, 184 and 186 can have a variety of different sizes, shapes, orientations and positions as long as the resulting stops function to contact against each other to prevent unwanted transverse movement between the barriers.

In alternative embodiments, it is appreciated that upper stops 180, 184 and lower stops 182 and 184 can be used independent of each other. Likewise, catches 140 and 150 can be used in combination with or independent of upper stops 180, 184 and/or lower stops 182 and 184.

Barrier 10 is typically made of a resiliently deformable polymeric material having strong, semi-rigid, and energy absorbing properties. Such materials include linear or cross-linked plastics which will deform under pressure but will not fail in a brittle manner. Examples of conventional polymeric materials include polyethylene (including High Density Polyethylene [HDPE]), polyvinylchloride, nylon, polycarbonate, and polypropylene. Additives such as dyes, pigments, and reinforcements, such as fibers, can also be added to the material. Florescent dies can be added to help barriers 10 glow at night for better direction of traffic. In one embodiment, it is preferred that barrier 10 be made from a recyclable plastic such as polyethylene or HDPE. This enables old or broken barriers to be ground down and recycled into new barriers.

Barrier 10 is typically made by blow molding. Of course, other molding processes, such as rotational molding, injection molding or die molding can also be used. Independent of the method used, it is generally desirable that walls of barrier 10 have a substantially uniform thickness so as to minimize shrink deformation. In one embodiment, the walls of barrier 10 have a thickness in a range between about 0.2 cm to about 1.5 cm with about 0.3 cm to about 0.8 being more common. The thickness is chosen to optimize desired deflection and required strength properties. Other dimensions can also be used.

Many advantages are realized by the different embodiments and features of the barrier disclosed herein. For example, the use of kiss-offs between the front wall and the back wall increases the strength and stability of the barrier. It also limits bowing the front and back wall so that displays can be mounted thereon. The unique configuration of the kiss-offs also enables them to support poles and other elongated members that are received within the barrier.

The engaging catches and the retention catches enable the barriers to be easily connected together. Because of the interconnection, the barriers can better restrain an impact force. Furthermore, because the engaging catches and the retention catches are integrally formed on the barriers, the inventive barrier system eliminates the need for separate connectors. The unique V-shaped configuration of the engaging catches and the retention catches also enables the barrier to be connected in a linear or curved line. The stops projecting from each side of the barrier also helps prevent tipping of one or more the barriers when the barriers are connected together. The inventive barrier also has many other benefits.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A traffic barrier comprising:

a housing having a front wall and an opposing back wall each extending between opposing first and second sidewalls, the housing also including a floor and an interior surface bounding a chamber, the interior chamber communicating with the exterior through an opening;

an engaging catch outwardly projecting from the first sidewall, the engaging catch having an elongated engaging lip that transversely extends across at least a portion of the first sidewall; and a retention catch outwardly projecting from the second sidewall, the retention catch at least partially bounding an elongated retention slot that transversely extends across at least a portion of the second sidewall, wherein the engaging catch and retention catch are configured so that for identical housings the engaging lip of one housing can interlock within the retention slot of the other housing; whereby relative movement of adjacent barriers is restricted.

2. The barrier of claim 1, wherein the engaging catch and the retention catch are each vertically spaced apart from the floor.

3. The barrier of claim 2, further comprising a drain hole formed on the first sidewall at a location between an engaging catch and the floor or on the second sidewall at a location between the retention catch and the floor.

4. The barrier of claim 3, further comprising a threaded sleeve encircling the drain hole.

5. The barrier of claim 3, wherein at least one of the engaging lip and the retention slot extends substantially across the entire width of the first sidewall or the second sidewall.

6. The barrier of claim 3, wherein when the floor is horizontally disposed, the engaging lip and the retention slot are substantially horizontally disposed.

7. The barrier of claim 3, further comprising:

an elongated engaging slot bounded between an engaging surface of the engaging catch and the first sidewall, the engaging slot having a substantially V-shaped transverse cross section; and the retention catch comprises an elongated retention lip that is configured to be received within the engaging slot of an identical second housing.

8. The barrier of claim 3, wherein the engaging lip has a centrally located apex that projects farthest out from the first sidewall, a first section that extends from the apex and slopes back toward the front face, and a second portion that extends from the apex and slopes back toward the back face, the first section and the second section of the engaging lip forming an outside angle in a range between about 190 and 240.

9. The barrier of claim 3, wherein at least the engaging lip or the sidewall has a substantially V-shaped transverse cross section when viewed in a plane disposed parallel to the floor.

10. A traffic barrier comprising:

a housing having a front wall and an opposing back wall each extending between a first sidewall and an opposing second sidewall, the housing also having a floor and an interior surface bounding a chamber, the chamber communicating externally through an opening; wherein at least the first sidewall has a substantially V-shaped transverse cross section, when viewed in a plane disposed parallel to the floor a first upper stop and a spaced apart first lower stop each projecting from the first sidewall; and a second upper stop and a spaced apart second lower stop each projecting from the second sidewall, the first and second upper stops and the first and second lower stops each being horizontally offset with each other such that for two identical housings the first sidewall of one housing can be mated with the second sidewall of the other housing so that the first upper stop and first lower stop of the first housing interact with the second upper stop and the second lower stop, respectively, of the other housing to prevent transverse separation of the barriers.

11. The barrier as recited in claim 10, wherein the first upper stop and the first lower stop are vertically and transversely spaced apart from each other.

12. The barrier as recited in claim 10, further comprising:

an engaging catch transversely extending across at least a portion of the first sidewall; and a retention catch transversely extending across at least a portion of the second sidewall, the engaging catch and retention catch being configured so that for identical housings the engaging catch of one housing can interlock within the retention catch of the other housing.

* * * * *